US008757271B2

(12) United States Patent
Senties

(10) Patent No.: US 8,757,271 B2
(45) Date of Patent: Jun. 24, 2014

(54) ARTIFICIAL LIFT INTEGRAL SYSTEM FOR THE PRODUCTION OF HYDROCARBONS FOR OIL WELLS BY MEANS OF PNEUMATIC PUMPING WITH NATURAL GAS AUTONOMOUSLY SUPPLIED BY OIL WELLS

(75) Inventor: Oscar Vazquez Senties, Mexico City (MX)

(73) Assignee: ENX Compressors SA DE CV, Pedro de los Pinos (MX)

( * ) Notice: Subject to any disclaimer, the term of this patent is extended or adjusted under 35 U.S.C. 154(b) by 247 days.

(21) Appl. No.: 13/024,842

(22) Filed: Feb. 10, 2011

(65) Prior Publication Data

US 2012/0152532 A1 Jun. 21, 2012

(30) Foreign Application Priority Data

Dec. 21, 2010 (MX) ..... MX/a/2010/014488

(51) Int. Cl.
*E21B 43/00* (2006.01)

(52) U.S. Cl.
USPC ..... 166/369; 166/250.15

(58) Field of Classification Search
USPC ..... 166/369, 250.15
See application file for complete search history.

(56) References Cited

U.S. PATENT DOCUMENTS 2,225,814 A * 12/1940 Youker ..... 585/330
2012/0000668 A1* 1/2012 Rexilius et al. ..... 166/369

* cited by examiner

*Primary Examiner* — William P Neuder
(74) *Attorney, Agent, or Firm* — Defillo & Associates, Inc; Evelyn A. Defillo

(57) ABSTRACT

A system and a method for the artificial pneumatic production of oil and gas which is self-supplied is provided. The well's originating gas separates in a skid of separation of oil and after gas is rectified, gas is injected again into the well; the gas injection is made to a pressure enough to lift the oil-gas mixture inside the well. The excess of gas is exhausted toward the closer processing station.

15 Claims, 1 Drawing Sheet

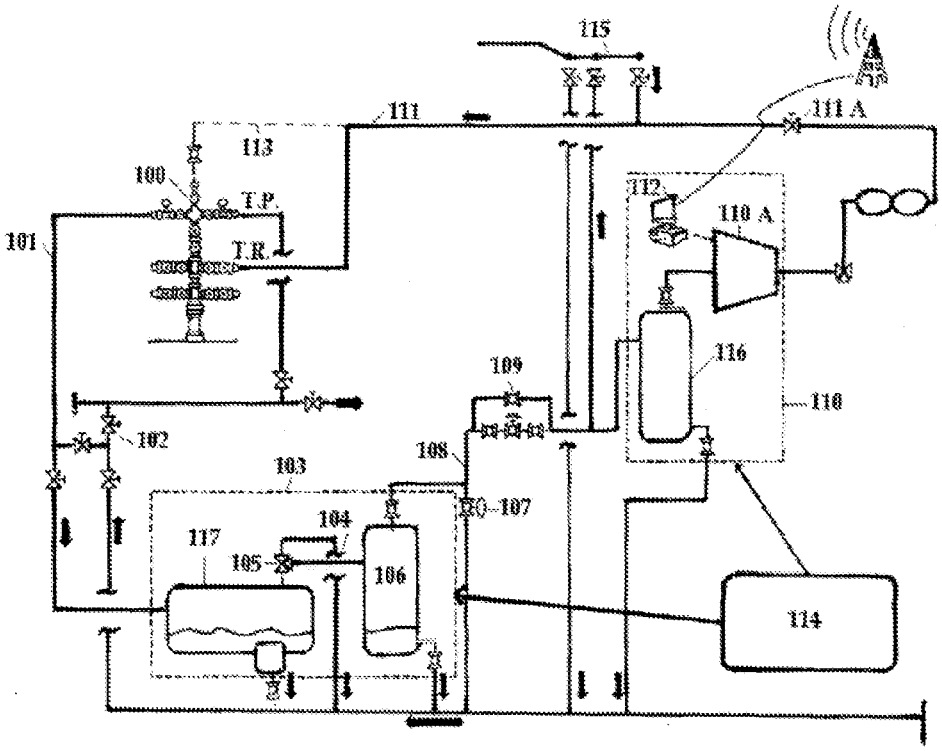
115
111
111 A
113
100
T.P.
T.R.
101
112
110 A
116
110
109
102
108
103
107
104
117
105
106
114

ARTIFICIAL LIFT INTEGRAL SYSTEM FOR THE PRODUCTION OF HYDROCARBONS FOR OIL WELLS BY MEANS OF PNEUMATIC PUMPING WITH NATURAL GAS AUTONOMOUSLY SUPPLIED BY OIL WELLS

The present invention refers to the field of hydrocarbons extraction from oil wells and more particularly, it refers to an integral production system and to a process to extract such hydrocarbons from wells that do not have a high pressure gas distribution pipeline to restore original production levels.

The described system is based on a pneumatic pumping system for the artificial production of oil wells.

BACKGROUND AND FIELD OF THE INVENTION

It is already known that if the static pressure of the deposit is larger than the sum of all the hydrocarbon pressure drops from the bottom of the well to its processing center, then the oil will naturally flow. However, if the static pressure is less than the result of the summation, some artificial production systems will be required.

The present invention refers to artificial production systems, which, as above mentioned, are used when the energy or pressure of the oil field is not enough to lift the fluids (oil-gas mixture) to the surface to be used by humans. In general, the artificial systems are classified into three big classes: mechanical pumping systems, pneumatic pumping systems, and electro-centrifugal systems.

The pneumatic pumping includes injecting a gas at a relatively-high pressure, in which the injected gas moves the fluids to the surface to reduce the pressure exerted by the fluid, expansion of the injected gas, or fluid displacement.

The pneumatic pumping is flexible, both in its configurations, as well as in the capacity it controls, is able to manage sand within the well, does not need much space for the facilities in surface, and with a single system several wells can be fed, and additionally, does not require modifications to the finished well for any type of variations, as it actually happens in the mechanical pumping, electro-centrifugal pumping, and progressive cavity.

The present invention relates to the field of pneumatic pumping with the patentable characteristic to be movable and to be adapted to the available space in the wells.

Following patent applications and patents related to the present invention are known.

U.S. Pat. No. 3,215,087 provides a new and improved system for the artificial gas lifting. In accordance with what is described by this patent, it was found that the lift efficiency may be improved through the intermittent injection of a viscous and immiscible fluid with the fluid that is intended to be recovered from the well, being displaced with gas coming from the well or from an external source through the annular lining-priming, passing through a valve (22) to the inside of the priming, and not from a pneumatic pumping system (BNA) self-supplied and continuous as in the present invention.

This patent discloses that fluids used for purposes of the invention are solutions that are practically immiscible with the fluids produced or extracted from the well, that do not adhere to casings, piping, and other equipment from which the fluids come into contact and that have enough viscosity to resist the cut during the flow. In the case where the fluid produced is crude oil, an aqueous solution that contains a polysaccharide, a poly-acrylamide, sulphonated aromatic poly-vinyl is used, or a soluble water thickener or water dispersant, in a concentration enough to produce a practically superior viscosity to the one of the crude oil, which is not the case in the present invention.

The MX Patent 43214, entitled "Method for Producing Oil from Partially Exhausted Wells" filed on Jun. 3, 1944, which is the closer state of the art and that shows the following differences regarding the present application:

a) The patented process is in the field of improved secondary recovery (EOR) while the one of the present application, hereinafter called as BNA system, (self-supplied pneumatic pumping) is an improvement of the pneumatic pumping as a system of artificial production (SAP);

b) In the patented process of the vapor fractions, injection recovered by means of distiller equipment and distillation columns are injected to a well for improving the viscosity of the oil of the entire oil field and that the rest of the wells improve their production through this action, positioning this invention in the oil recovery system.

The U.S. Pat. No. 4,666,377 entitled "Method and Lift Pump and Raising Liquids" refers to an apparatus and specifically it is related to a sub-superficial pump, submerged at approximately 50% of the fluid column contained in the well, and uses liquid such as motor fluid and not gas as in the present invention. Additionally, the use of auxiliary systems in this disclosure is missing.

The U.S. Pat. No. 5,006,046 entitled "Method And Apparatus For Pumping Liquid From a Well Using Wellbore Pressurized Gas" is based on the insertion of a pipe inside a well liner to extract oil from the bottom, by injecting pressurized gas in cyclic form and controlled by means of a sensor to measure the liquid level and a controlling valve at surface that enables gas going through the well and pushes the oil to the surface. This patent remarkably differs from the present invention since it is based on a continuous operation system and does not indicate the use of separation and compression gas equipment, so it needs an external source to provide gas under pressure.

The U.S. Pat. No. 6,298,918, entitled "System For Lifting Petroleum By Pneumatic Pumping" involves the development of an apparatus and procedure for the application of a fluid accumulation camera inside a well and the injection in cyclic form of a gas under pressure to displace the oil to the surface, which differs from the present invention in that, it does not use any equipment to store fluids inside the well and that also requires, as specified, that they require gas under pressure as an external source.

The U.S. Pat. No. 6,354,377 entitled "Gas Displaced Chamber Lift System Having Gas Lift Assist" comprises in a modification of the previous patent and among main changes, there is the inclusion of a second liquid accumulation camera in the bottom of the well and a multi-stage compressor with a capacity of providing a pressure higher than 5,000 psi to inject gas to the chambers. It is not specified, but it is required, that a source of external gas under pressure and the process is also cyclically differing from the present invention.

The U.S. Pat. No. 7,147,059 entitled "Use Of Downhole High Pressure Gas In a Gas-Lift Well And Associated Method" consists on the application of equipment and methods to isolate and use the high pressure gas zones of a well as high pressure supplying sources are to be used as continuous pneumatic pumping. The difference is obvious to the present application, since it does not use gas associated with the production of oil, or any of the separation and compression equipment.

BRIEF DESCRIPTION OF THE INVENTION

The invention refers to a system that includes movable equipment for the artificial production of wells with low production that comprises at least one separating skid including separating and rectification equipment, at least one compression skid including a compressor, an auxiliary equipment for energy supply, and communication and control equipment, among others, each one mounted on a solid and movable structure with capacity to support weight, dimensions and pressures of the integrating components, that will be named hereinafter as skid and is designed exclusively to make its mobilization easy for the required sites.

The system of the present invention is designed and built for the artificial production through pneumatic pumping of oil and gas producing wells. Worth to mention is that the system does not need connection to an expensive infrastructure of dry or humid natural gas distribution network under high pressure since the gas to be injected to the well is derived thereof.

The system is considered highly effective, as compared with any other one that requires the use of external supplying sources as inert gases injecting units or any other such as nitrogen, which contaminates gas and oil produced causing a decrease in the commercial value of the same due to physical and chemical property loss. Another advantage is that using the same natural gas produced from the intervened well, mixture improves increasing production, so that this system is completely autonomous, independent, efficient and portable.

BRIEF DESCRIPTION OF THE FIGURE

FIG. 1 illustrates schematically and as a block-diagram, the main components used in the innovative and inventive process represented by means of arrows.

DETAILED DESCRIPTION OF THE INVENTION

The present process is an improvement for a pneumatic pumping system (SAP) for the artificial production of oil wells since it is not necessary for the user to incur expensive investments associated with high pressure gas infrastructure to the well, nor assumes the risks associated with the productive status of the well, in case it does not justify said investment caused by volumes (usually low) that are obtained in the remaining lifetime of the well.

In a first embodiment, it refers to a process that comprises:

a) The selection of the well to be exploited following the criteria of wells selection through pneumatic pumping by PhD Kermit Brown in his book Gas Lift Theory and Practices, published by Petroleum Pub. Co. and with registration ISBN 10 0878140247 of 1967; and b) Designing the system of artificial production under the technical recommendations used in industry oil.

The step a) is carried out by calculating, by means of that described in the book of Brown, the following parameters:

Separation pressure,

Injection depth,

Injection pressure,

Temperature of oil and gas in the surface

Optimal injection gas volume,

Oil, gas, and water production in the surface.

With these parameters it is determined, in principle, if the well in question is adequate or not for profitable production.

In case of being so, it proceeds to step b) of the present invention, that consists of calculating the technical characteristics of the various skids or grouped components.

The first step within the calculation of the skids is b1), calculating the technical characteristics that the skid, including the separating and rectifying equipment, must comply, following international standards API 12J and the recommendations of the GPSA Engineering Data Book Section 7.

The following step is b2), determining the capacity and size of the compressor considering the gas volume to be injected and optimal pressure obtained in the designing process of the system, under the API 11P standards.

The auxiliary systems of energy b3) are calculated in terms of the energy requirements of the separating skid and compression skid and the various minor components such as measurement and/or reading valves and equipment.

The system of the present invention (BNA), at the same location as the well of:

a compression skid (110) with at least a compressor (110A) equipment with power combined from 35 to 1120 Kw and a second rectifier (116) located upstream of the second rectifying device near an input of the compression skid;

a separating skid with at least one equipment of oil and gas separation having separated measurement of oil flow and gas;

a skid with at least one gas rectifying equipment; and

Auxiliary energy supply subsystems for the instrumentation system and electric facilities.

One of the operation conditions of the BNA system is that there is not an external gas under pressure supplying system, since for the invention purpose and in a second embodiment thereof, the BNA system substitutes such supply for the artificial production of low-production wells.

The components referred above are arranged and distributed so as to occupy the least space possible in order to avoid pressure drops. As known for experts in the art, piping used complies with ASME specifications 31.3.

In the preferred mode of the invention, the skids (separating skid and compression skid) and the well are equidistantly positioned and preferably to a 30-meter distance between thereof to optimize the area of installation and decrease the pressure drops of the different products: oil-gas, oil and gas mixes.

In another embodiment of the present invention, it includes pumps and a storage system for oil and water displacement produced at the same location considering that wells pressure may be decreased to one atmosphere and then increasing with this productive life of this type of well.

The process starts with the transportation of the oil-gas mixture, of the well (100) towards the separating skid (103), by means of production pipes (101), which are a part of the inventive process. Already inside the separating skid (103), the gaseous and liquid separation of the phases are performed (oil and water), transferring the liquids to the closest processing center, the gas is passed by means of pipes (104) to the rectifying stage inside the separating skid, during the rectifying step, the gas is cleaned from liquid particles suspended therein. After rectification, the gas is driven to the compression skid (110) to the suction inputs of the compressor, through a piping that is characterized for starting in first diameter on the rectifier output and then changes to a second diameter that is bigger than the first diameter and finalizing in the compressor input with a third diameter that is equal or smaller to the first diameter.

The gas-oil exhaust bypass valve (102) is generally kept closed during the passing of the oil and gas to the separator (117); it is only opened when there is maintenance service in the well to send the product directly to the processing center.

Inside the separating skid (103), in the piping (104) that communicates the separator (117) with the rectifier (106), there is at least one control valve (105) (gas excess valve), in order to open and purge any exceeding or gas exceeding volume required by the BNA system design to the processing center; thus avoiding an undesired increase in the separation pressure that might affect the well production and the compressor functioning when working with a higher pressure than the one of the design.

Connected between the piping to the processing center and the rectifier (106), a gas excess control valve is located (107) that is a pneumatic control valve (although another type of actuator may be used) that remains closed and operates jointly with the valve (105) and opens only to send exceeding gas to the processing center.

Gas passageway line (108) to regulation package leads gas to a permissible working pressure for regulation equipment, same that was obtained with the intervention of the exceeding valve (107).

The gas, before reaching the compressor's suction, goes by a set of regulating valves (109) which keeps the pressure in the conduit piping to the compression skid (110) constant before any pressure variation that can occur from the separating skid (103). Already inside the compressor, the pressure of the gas to attain the pressure from injection to the well, within the design range, increases.

Compression process takes effect in the compression skid (110) with at least one compressor (110A) of positive displacement driven by a motor which can be an internal combustion engine or an electric motor, adjusted to the separation pressures and the motor revolutions per minute (rpm) to attain optimal volume and pressure of gas injection to maximize well production. All these processes are supported by the auxiliary energy systems (114).

Gas that already requires injection pressure, gets out of the compression skid (110) towards the well (100) by at least one arrangement or distribution of valves and flow regulation (111A) and purge piping (111) to access to the well by means of access valves of the well casing and to be driven through the same even until the depth of design injection, blending in with the production of oil-gas mixture inside the well priming that is associated to a hydrocarbons oilfield reducing the weight of the production column.

The inclusion of pumps and a storage system (114) for oil and water displacement that are produced at the same location, considering well pressure decreases to an atmosphere, improves the productive life of the intervening well.

In order to avoid corrosion-due damage to the well casing, a flexible piping (113) or alike is included, with a smaller diameter to the priming of the well intervened, where the gas injected to the optimal injection depth is channeled, in that way to mix with the production of the gas-oil mixture.

A last component of the system is a measurement and control equipment of the system (112) as well as its most important components and monitoring the production of the gas-oil mixture, of the isolated oil and of the isolated gas. A remote data monitoring and collection system was implemented by means of telemetry signals to supervise and control the operations from a remote point.

Another embodiment or facility the system has, is having arrangements of interconnection valves (115) to connect other movable BNA systems for maintenance to the installed equipment purposes and assuring the operational efficiency and continuous production.

The process described above is implemented thanks to the interconnection between the skids and components mentioned above.

The invention claimed is:

1. A portable pneumatic system for artificial production of oil wells including production pipes, the system comprising:

a separating skid including at least one oil and gas separation equipment and a first rectifying device connected to the oil and gas separation equipment, the oil and gas separation equipment separately measures an oil flow and a gas flow;

a compression skid including a second rectifying device located near an input of the compression skid and at least one compressor located downstream of the second rectifying device; and auxiliary subsystems to supply energy to the system and electric facilities;

wherein the oil and gas separation equipment is connected to the first rectifying device by using a first pipeline having a valve;

wherein the separating skid is connected to the compression skid by using a second pipeline including a gas excess control valve and a series of regulating valves.

2. The system according to claim 1, further including a gas-oil exhaust bypass valve before entering the separating skid;

wherein a mixture of oil and gas derived from the oil well is transported from the oil well toward the separating skid by using a production piping, the separating skid separates the oil flow from the gas flow, the oil flow is transported to a processing center, the gas flow is transported to the first rectifying device of the separating skid by using the first pipeline.

3. The system according to claim 2, wherein the valve opens and transports exceeding gases to the processing center.

4. The system according to claim 3, wherein the gas excess control valve works in conjunction with the valve, the gas excess control valve has a closed position and opens to send the exceeding gases to the processing center.

5. The system according to claim 1, wherein the regulating valves maintain a constant pressure on the second pipeline, the compressor increases a gas pressure to an injection pressure on the well.

6. The system according to claim 1, wherein the compressor is a positive displacement compressor, wherein the gas is transported to the well by using a flexible exhaust piping and bypass valves, the flexible exhaust piping connects to access valves of a well casing.

7. The system according to claim 1, further comprising a set of pumps and a storage system to store oil and water displaced from the well.

8. The system according to claim 1, wherein the separating skid, the compression skid, and the well are positioned equidistantly.

9. The system according to claim 1, wherein the compressor device has a power from 35 to 1120 Kw.

10. The system according to claim 1, further including interconnection valves to connect to a second system of artificial production or for maintenance purposes.

11. A process for the artificial production of gas, using the portable system of claim 1, wherein the process includes the steps of:

a) selecting the well;

b) transporting an oil-gas mixture from the well to the separating skid;

c) separating an oil phase from a gaseous phase from the oil-gas mixture;

c) transporting the oil phase to a processing center;

d) transporting the gaseous phase to the rectifying skid where gaseous phase is rectified;

e) passing the gaseous phase through a second pipeline by using the control valve, the second pipeline including a first diameter matching a diameter of an output on the separating skid, then continues with a second diameter that is bigger than the first diameter, and ends with a third diameter that matches a diameter of an input on the compressor, the third diameter is the same or smaller than the first diameter;

f) sending excess gases to the processing center and remaining gases to the compressor;

g) increasing a pressure to an injection pressure suitable to lifting the oil-gas mixture from the well;

h) keeping the pressure constant in second pipeline;

i) injecting gases leaving the compressor inside the well by using an exhausting piping and bypass valves, the exhaust piping connects to the access valves to a well casing piping;

j) repeat step a).

12. The process according to claim 11, wherein before the injection step, the gas is led to a series of pumps and storage systems.

13. The process according to claim 11, further including wherein auxiliary energy supply systems and communication and control equipment.

14. The process according to claim 13, wherein inside the separating skid the oil and gases are separated.

15. A portable pneumatic system for artificial production of oil wells including production pipes, the system comprising:

a separating skid including at least one oil and gas separation equipment and a first rectifying device connected to the oil and gas separation equipment, the oil and gas separation equipment separately measures an oil flow and a gas flow;

a compression skid including a second rectifying device located near an input of the compression skid and at least one compressor located downstream of the second rectifying device;

auxiliary subsystems to supply energy to the system and electric facilities;

a flexible piping connected to the well to introduce the gas, the flexible piping having a diameter smaller than a diameter of a casing on the well;

wherein the oil and gas separation equipment is connected to the first rectifying device by using a first pipeline having a valve;

wherein the separating skid is connected to the compression skid by using a second pipeline including a gas excess control valve and a series of regulating valves;

wherein the second pipeline includes a first diameter matching a diameter of an output on the separating skid, then continues with a second diameter that is bigger than the first diameter, and ends with a third diameter that matches a diameter of an input on the compressor, the third diameter is the same or smaller than the first diameter.

* * * * *